US005226473A

United States Patent [19]

Knutsson et al.

[11] Patent Number: 5,226,473

[45] Date of Patent: Jul. 13, 1993

[54] PLATE HEAT EXCHANGER

[75] Inventors: Roger Knutsson, Lund; Nils-Åke Jönsson, Staffanstorp, both of Sweden

[73] Assignee: Alfa-Laval Thermal AB, Lund, Sweden

[21] Appl. No.: 768,977

[22] PCT Filed: Apr. 29, 1991

[86] PCT No.: PCT/SE91/00304

§ 371 Date: Oct. 9, 1991

§ 102(e) Date: Oct. 9, 1991

[87] PCT Pub. No.: WO91/17405

PCT Pub. Date: Nov. 14, 1991

[30] Foreign Application Priority Data

May 10, 1990 [SE] Sweden ..... 9001695

[51] Int. Cl.[5] ..... F28F 3/08

[52] U.S. Cl. ..... 165/78; 165/167

[58] Field of Search ..... 165/78, 166, 167

[56] References Cited

U.S. PATENT DOCUMENTS

| | | | |
|---|---|---|---|
| 2,621,028 | 12/1952 | Newhall | 165/78 |
| 3,448,796 | 6/1969 | Usher | 165/78 |
| 4,499,942 | 2/1985 | Allison | 165/78 |
| 5,056,590 | 10/1991 | Bohn | 165/78 |

*Primary Examiner*—Allen J. Flanigan

*Attorney, Agent, or Firm*—Davis Hoxie Faithfull & Hapgood

[57] ABSTRACT

The present invention relates to a plate heat exchanger with a number of heat transfer plate (1) arranged between two end plates (3,4). Two guiding bars, which extend from one end plate (3) to the other end plate, are formed in one piece of one and the same rod (5).

5 Claims, 2 Drawing Sheets

FIG 5
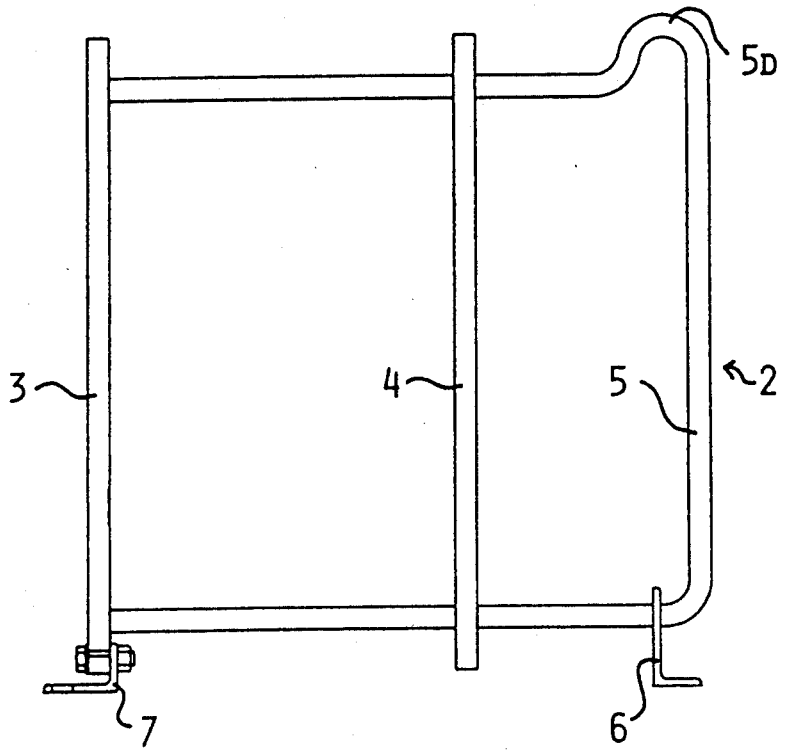
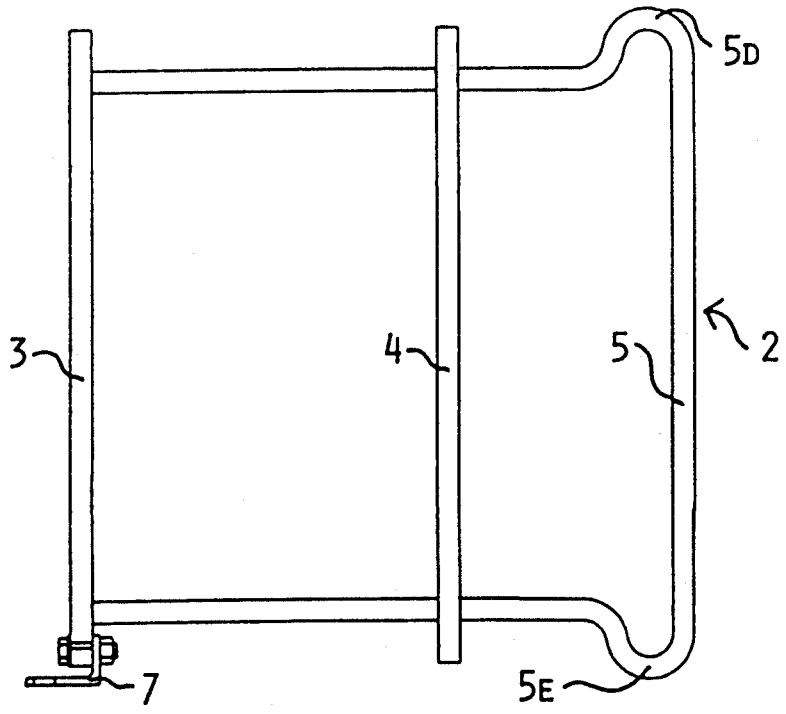
FIG 6

PLATE HEAT EXCHANGER

The present invention relates to a plate heat exchanger having a number of heat transfer plates arranged in a frame comprising two end plates, between which the heat transfer plates are arranged, and two guiding bars. The guiding bars are spaced from each other, extend from one of the end plates to the other are arranged to guide the heat transfer plates.

A plate heat exchanger of this kind is described in GB A 2107845. It has a frame comprising two end plates, a supporting column, an upper carrying bar and a lower guiding bar. The carrying bar and the guiding bar are tightened in the supporting column and at the one end plate. Thus, several different components are required to assemble the frame. The cost for producing these components is relatively high and a long time is required to assemble the frame. In addition, the storage space required for the different components is voluminous.

An object of the present invention is to simplify the construction of the plate heat exchanger and to lower the production cost of the same.

This object can be obtained by a plate heat exchanger of the sort described, which is characterized in that the guiding bars are parts of one and the same rod, which extends in one piece from one of the end plates, past the other end plate and back to the first end plate.

Because the frame of a plate heat exchanger according to the present invention comprises only a few components, namely an integrated carrying and guiding bar two end plates and means for their assembly, assembly the plate heat exchanger becomes very simple. The cost of producing these components and also the cost of the different working operations required to assemble the frame are reduced compared to known practices.

Figure 2:
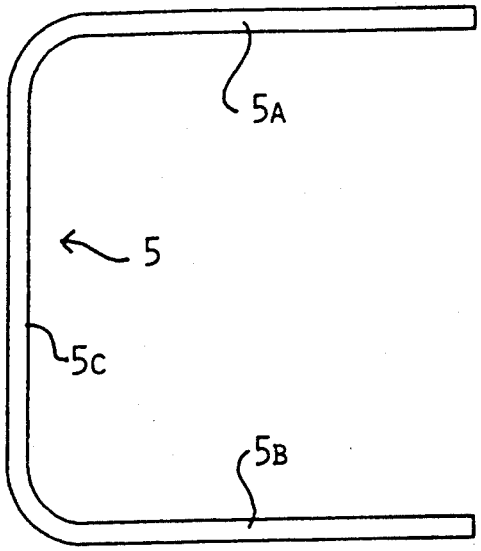
Figure 1:
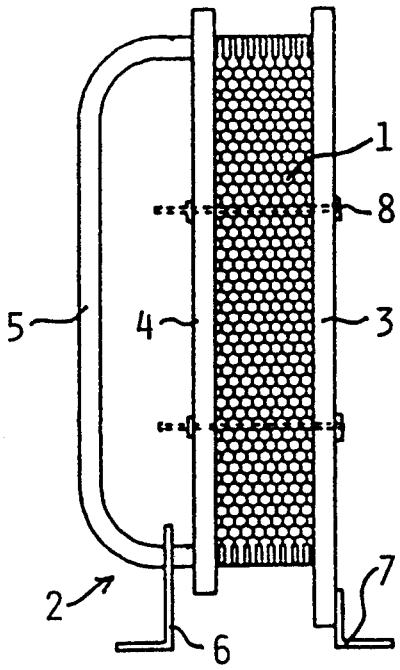
Figure 3:
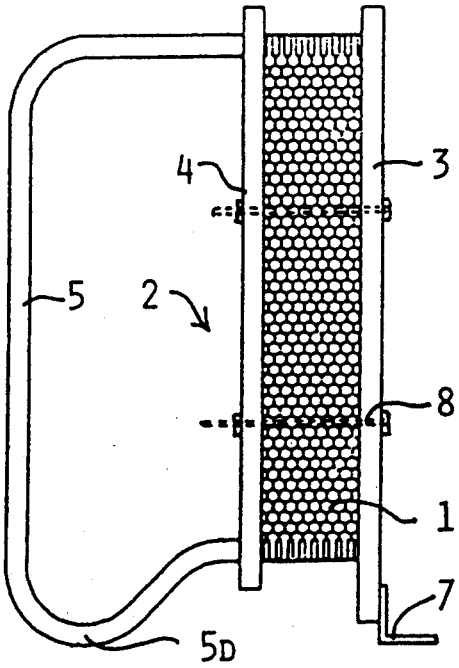
Figure 4:
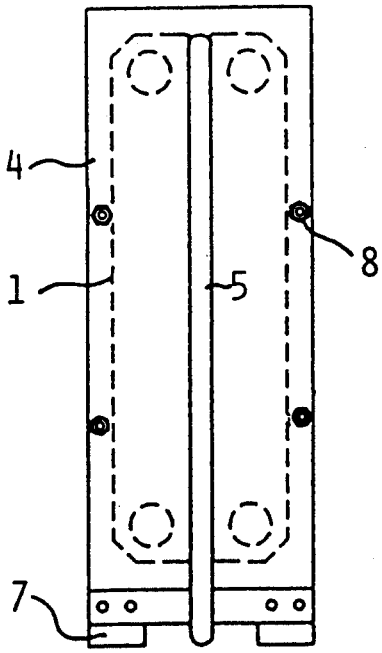

The invention will be described in more detail with reference to the accompanying drawings, in which:

FIG. 1 shows a view of a plate heat exchanger in accordance with the invention,

FIG. 2 shows a view of an integrated carrying and guiding bar included in the plate heat exchanger according to FIG. 1, FIG. 3 shows a view of an alternative plate heat exchanger in accordance with the invention, FIG. 4 shows a side view of the plate heat exchanger of FIG. 3, FIG. 5 shows a view of an alternative assembly of the frame included in the plate heat exchanger according to FIG. 3, and FIG. 6 shows a view of an alternatively shaped frame.

The plate heat exchanger shown in FIG. 1 comprises a group of several heat transfer plates clamped together by a frame 2. The heat transfer plates 1 are pressed between two end plates 3 and 4, namely an essentially fixed frame plate and a movable pressure plate. For this purpose there are a number of tightening bolts 8 (only shown schematically) between the end plates, which are intended to keep the heat transfer plates together. The frame has a continuous rod 5, which in own piece forms an upper carrying bar and a lower guiding bar, to carry and guide the heat transfer plates 1. The rod 5 extends through the plate heat exchanger perpendicularly from the end plate 3 through the intermediate heat transfer plates and through the other end plate 4. The rod 5 thus extends substantially parallel to the end plates 3 and 4, and then once again through the end plate 4 and heat transfer plates of the heat exchanger to the end plate 3. In the embodiment, whose in FIG. 1 the rod 5 extends through the heat transfer plates 1 but the heat transfer plates 1 may of course only abut the rod 5. A support in shape of a supporting foot 6 is attached tot he rod 5, and another supporting foot 7 is attached to the end plate 3. The rod 5 is fastened in a suitable way (details not shown) to the end plate 3, i.e. The stationary frame plate, and extends freely through the other end plate 4, i.e. The pressure plate.

In FIG. 2 the rod 5 is shown separately. It consist of a bent bar stock having a suitably shaped cross-section, for instance round, depending on how the existing recesses of the heat transfer plates are designed. The rod 5 of the present embodiment is essentially U-shaped one of its legs forming one of the bars, the other leg forming the second bar and the intermediate section, keeping the legs together, forming a supporting column. The rod 5 thus comprises an upper horizontal portion 5A, a lower horizontal portion 5B and a vertical portion 5C. These portions replace in a single component, the three components, previously used namely the carrying br, the guiding bar and the supporting column.

The rod 5 may be further bent, as appears from FIG. 3, and be provided with a protruding portion 5D, forming a supporting foot integrated with the rod.

If the rod 5, according to FIG. 3, is turned upside down and is supplemented with a detachable supporting foot 6, as appears from FIG. 5, one and the same kind of rod 5 can be used for several different frames of different sizes. The distance, from the lower attachment of the rod in the end plate 3 to the ground, can be altered with different supports for different designs of the frames.

In FIG. 6 a further embodiment of the rod 5 according to FIG. 3 is shown, which has been bent once more and has thus been provided with an additional protruding portion 5E, forming an integrated support foot, which has a different size from that of the protruding portion 5D. This rod 5 can be turned upside down, in the same way as the rod according to FIG. 5, such that one and the same rod 5 may be used for two different frames.

The protruding portion 5D or 5E, according to FIGS. 3-6, are of such a size that the distance between the legs is sufficiently greater in the area of the protruding portion than along remaining portions of the legs, that the heat transfer plates can be inserted and removed from the plate heat exchanger without the need of tipping them to any considerable extend between said bars. The heat transfer plates may thus be inserted and removed vertically in assembling them between said bars. In practice the plate heat exchanger may thereby be made shorter, compared to known designs.

We claim:

1. Plate heat exchanger comprising a frame having two end plates, a plurality of heat transfer plates between the end plates, and a guiding bar for guiding the heat transfer plates, said guiding bar comprising two legs extending substantially parallel to one another from one of said end plates to the other, and a connecting part joining one end of one leg with the corresponding end of the other leg, said legs and said part being integrally formed as a single unitary element.

2. Plate heat exchanger according to claim 1, wherein the guiding bar is U-shaped.

3. Plate heat exchanger according to claim 1 comprising means to keep the heat transfer plates together between the end plates.

4. Plate heat exchanger comprising a frame having two end plates, a plurality of heat transfer plates between said end plates and a U-shaped guiding bar for guiding the heat transfer plates comprising two legs extending substantially parallel to one another from one of said end plates to the other and a connecting part joining one end of each leg to the corresponding leg of the other, said legs and said part being integrally formed as a single unitary element, each of said legs having a protruding portion forming a support foot.

5. Plate heat exchanger according to claim 9, characterized in that the distance between the legs is so much greater in the area of the protruding portion than along the remaining portions of the legs, that the heat transfer plates can be inserted in and removed from the plate heat exchanger without the need of inclination to any considerable extent between said bars.

* * * * *

UNITED STATES PATENT AND TRADEMARK OFFICE

CERTIFICATE OF CORRECTION

PATENT NO. : 5,226,473

DATED : July 13, 1993

INVENTOR(S) : Knutsson, et. al.

It is certified that error appears in the above-indentified patent and that said Letters Patent is hereby corrected as shown below:

| | |
|---|---|
| Col. 1, line 9 | before "are", insert --and--. |
| Col. 1, line 62 | cancel "own" and substitute --one--. |
| Col. 2, line 3 | cancel "whose" and substitute --shown--. |
| Col. 2, line 6 | cancel "tot he" and substitute --to the--. |
| Col. 2, line 9 | cancel "The" and substitute --the--. |
| Col. 2, line 11 | cancel "The" and substitute --the--. |
| Col. 2, line 12 | cancel "consist" and substitute --consists--. |
| Col. 2, line 16 | after "U-shaped", insert a comma --,--. |
| Col. 2, line 23 | cancel "br" and substitute --bar--. |
| Col. 2, line 51 | cancel "extend" and substitute --extent--. |
| Col. 2, line 65 | (Claim 1, last line) after "element", insert --, at least one of said legs having a protruding portion forming a support foot.-- |

UNITED STATES PATENT AND TRADEMARK OFFICE

CERTIFICATE OF CORRECTION

PATENT NO. : 5,226,473
DATED : July 13, 1993
INVENTOR(S) : Knutsson, et. al.

It is certified that error appears in the above-indentified patent and that said Letters Patent is hereby corrected as shown below:

Col. 4, line 3 (Claim 5) cancel "claim 9" and substitute --claim 4--.

Signed and Sealed this

Fifteenth Day of March, 1994

*Attest:*

*Attesting Officer*

Bruce Lehman

BRUCE LEHMAN

*Commissioner of Patents and Trademarks*